US009024170B1

(12) United States Patent
Marshall et al.

(10) Patent No.: US 9,024,170 B1
(45) Date of Patent: May 5, 2015

(54) MIDI CONTROLLER CIRCUIT FOR DRAWBAR-TYPE ORGAN INTERFACES

(71) Applicant: Analog Outfitters, Inc., Champaign, IL (US)

(72) Inventors: Robert Marshall, Champaign, IL (US); Varun Ram, Champaign, IL (US); Glenn Francisco, Champaign, IL (US)

(73) Assignee: Analog Outfitters, Inc., Champaign, IL (US)

( * ) Notice: Subject to any disclaimer, the term of this patent is extended or adjusted under 35 U.S.C. 154(b) by 0 days.

(21) Appl. No.: 14/214,102

(22) Filed: Mar. 14, 2014

Related U.S. Application Data

(60) Provisional application No. 61/781,178, filed on Mar. 14, 2013.

(51) Int. Cl.
*G10H 7/00* (2006.01)
*G10H 1/00* (2006.01)

(52) U.S. Cl.
CPC ..... *G10H 1/0066* (2013.01)

(58) Field of Classification Search
USPC ..... 84/343–345, 645
See application file for complete search history.

(56) References Cited

U.S. PATENT DOCUMENTS

| | | | | | |
|---|---|---|---|---|---|
| 4,074,605 | A * | 2/1978 | Shigeta et al. | 84/697 |
| 4,227,432 | A * | 10/1980 | Bagus | 84/682 |
| 4,282,787 | A * | 8/1981 | Walborn | 84/673 |
| 4,348,932 | A * | 9/1982 | Kashio | 84/622 |
| 4,475,430 | A * | 10/1984 | Bione et al. | 84/691 |
| 8,779,272 | B2 * | 7/2014 | Iwase | 84/622 |
| 2003/0075431 | A1 * | 4/2003 | Nagashima | 200/529 |
| 2013/0025436 | A1 * | 1/2013 | Iwase | 84/623 |

* cited by examiner

*Primary Examiner* — Jeffrey Donels
(74) *Attorney, Agent, or Firm* — Singleton Law Firm, P.C.

(57) ABSTRACT

Embodiments of the present invention provide a circuit for a MIDI controller that may be used with keyboard and drawbar interfaces provided by a variety of models of drawbar-type electric organs. Such a circuit may be connected to numerous different configurations of drawbar-type organ interfaces having differing numbers of keys, switches, and drawbars, as well as stand-alone units having only keys and drawbars, only foot pedals and drawbars, or only drawbars. Embodiments of the present invention further provide a method for determining the position of each drawbar of a drawbar-type organ interface using binary logic.

14 Claims, 5 Drawing Sheets

MIDI CONTROLLER CIRCUIT FOR DRAWBAR-TYPE ORGAN INTERFACES

CROSS-REFERENCE TO RELATED APPLICATIONS

The present application claims the benefit of U.S. Provisional Patent Application No. 61/781,178, filed Mar. 14, 2013, the content of which is hereby incorporated by reference in its entirety.

BACKGROUND OF THE INVENTION

A MIDI controller provides a microcontroller that generates and transmits electronic signals to a music synthesizer in accordance with the MIDI protocol. A MIDI controller may be controlled by a human interface component that emulates the form of a traditional musical instrument. While MIDI controllers may have interfaces emulating a variety of instruments, most commonly, a MIDI controller is controlled by a keyboard interface, providing a MIDI keyboard controller, a well-known class of electronic musical instrument.

The microcontroller component of a MIDI keyboard controller is generally designed for a keyboard interface with a predetermined number of keys. As a result, the circuit design and wiring of a conventional MIDI controller is designed to provide a number of microcontroller inputs for wiring to a particular number of keys.

It is also known that keyboard instruments may have other human interfaces aside from a keyboard. For example, a drawbar-type electric organ is a type of keyboard instrument incorporating a set of drawbars that may be operated to control sounds generated electromagnetically by a set of tonewheels. Sound generated by a drawbar-type organ is formed by additive synthesis, and is made up of the sum of a number of component waveforms. Each component waveform is generally referred to as a partial. Each note played by the organ is a sum of nine different, integer-related partials, called harmonics.

A user of a drawbar-type organ may control the waveform composition of sound generated by the organ by setting each drawbar of the organ into different configurations. Each drawbar corresponds to a particular harmonic, a sinusoidal waveform having a particular frequency proportional to the teeth of a tonewheel. The position of the drawbar, generally ranging over nine positions from fully extended to fully depressed, corresponds to the volume of that harmonic, amplified by an amplifier circuit of the organ. The positions of a drawbar range from a 0 position, where a corresponding harmonic is silent, to an 8 position, where a corresponding harmonic is at full volume.

Drawbar-type organs were produced by the Hammond Instrument Company in different models that may have up to 146 keys and variable numbers of drawbars. Keys may be arranged in rows, also referred to as manuals. Each manual may be controlled by one or more sets of drawbars. Therefore, the notes of one manual can have vastly different timbres than those of another depending on how the drawbars are configured. Drawbar-type organs may further include a one-octave or a two-octave set of foot pedals to produce lower bass tones, which may be controlled by additional drawbars. The many models of drawbar-type organs that were produced provided these elements in a variety of quantities and configurations.

Among musical instruments, drawbars are only found on drawbar-type organs or on some electronic keyboard instruments that emulate the sound of tonewheels found on such organs. While several companies produce electronic keyboard instruments emulating drawbar-type organs, and some such instruments incorporate drawbars as an interface, each such instrument only provides for a fixed configuration having a set number of keyboards and drawbars.

There has not been a MIDI controller design that may be wired to a variety of human interfaces corresponding to the many models of drawbar-type organs produced, each having different quantities and configurations of keys and drawbars.

BRIEF SUMMARY OF THE INVENTION

Embodiments of the present invention provide a circuit for a MIDI controller that may be used with a variety of configurations of keyboard interfaces incorporating drawbars. In particular, embodiments of the present invention provide a circuit for a MIDI controller that may be used with keyboard and drawbar interfaces provided by a variety of models of drawbar-type electric organs.

Embodiments of the present invention provide a circuit board and a drawbar-type organ interface as a human interface for a MIDI controller. In embodiments of the present invention, such a drawbar-type organ interface may include any, some, or all of a keyboard, a set of foot pedals, a set of switches, and a group of drawbars. In embodiments of the present invention, the circuit board interfaces with any, some, or all of manual and foot pedal key contacts, switches, and drawbars of a drawbar-type organ interface, and outputs MIDI instructions corresponding to the state of any, some, or all of these elements.

Embodiments of the present invention further provide a method for determining the position of each drawbar of a drawbar-type organ interface using binary logic.

DETAILED DESCRIPTION OF THE INVENTION

Figure 1:
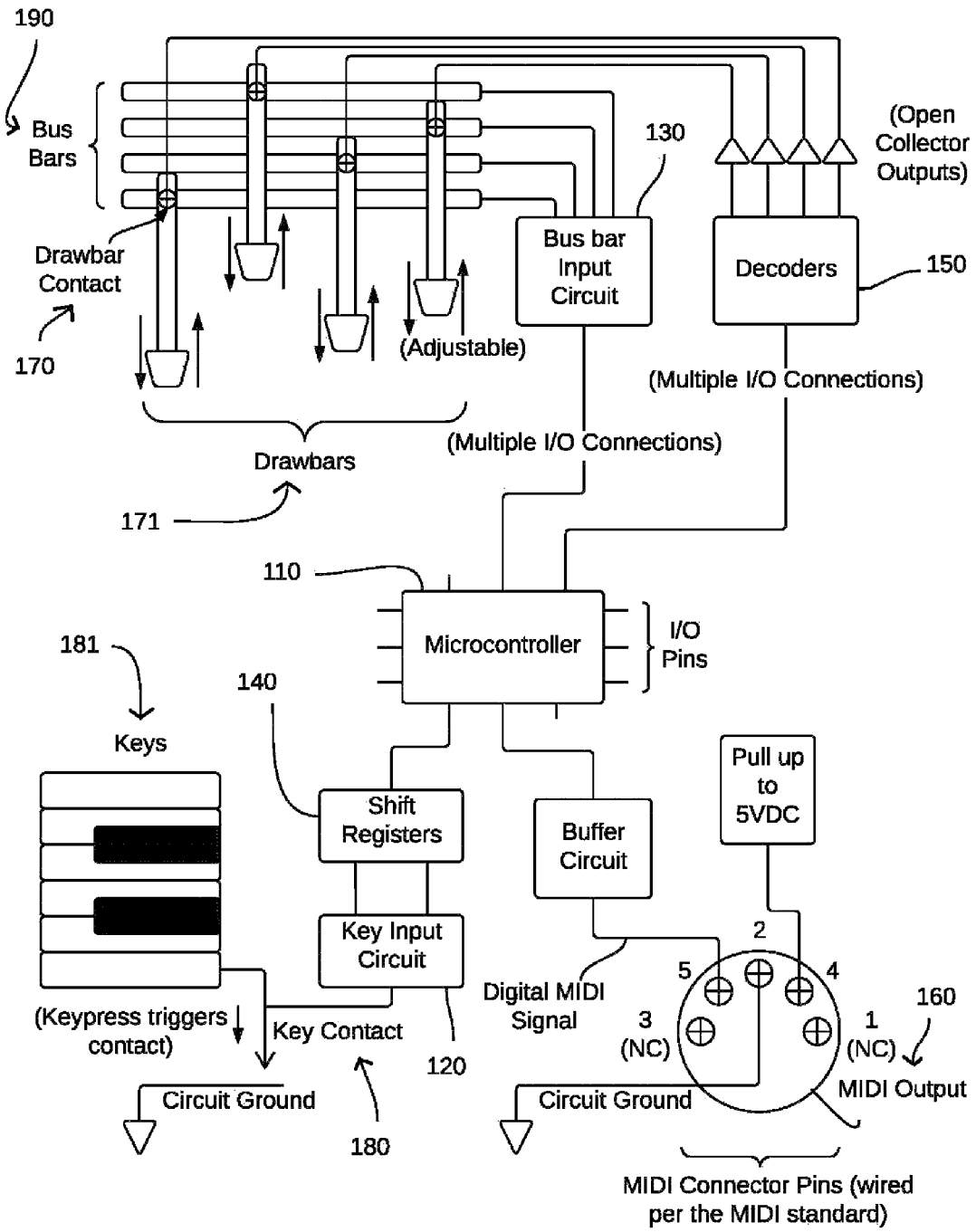
FIG. 1 illustrates a diagram illustrating all major components for a MIDI controller according to an embodiment of the present invention.
Figure 2:
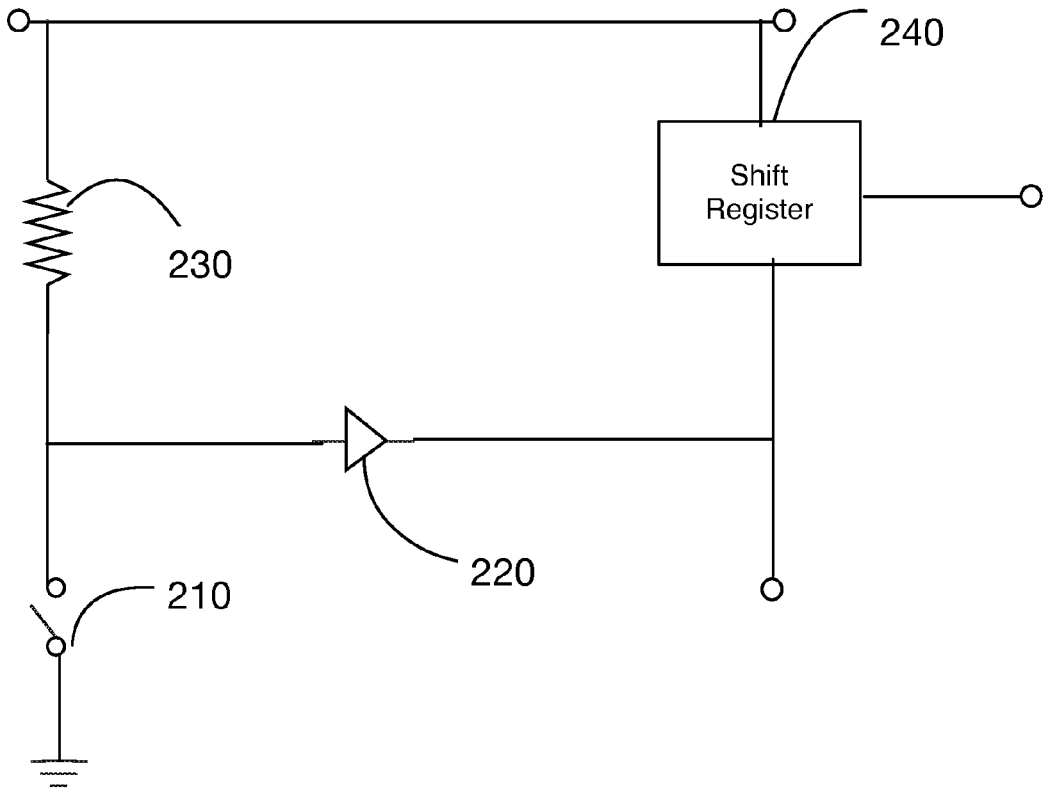
FIG. 2 illustrates a circuit schematic corresponding to a key input circuit according to an embodiment of the present invention.
Figure 3:
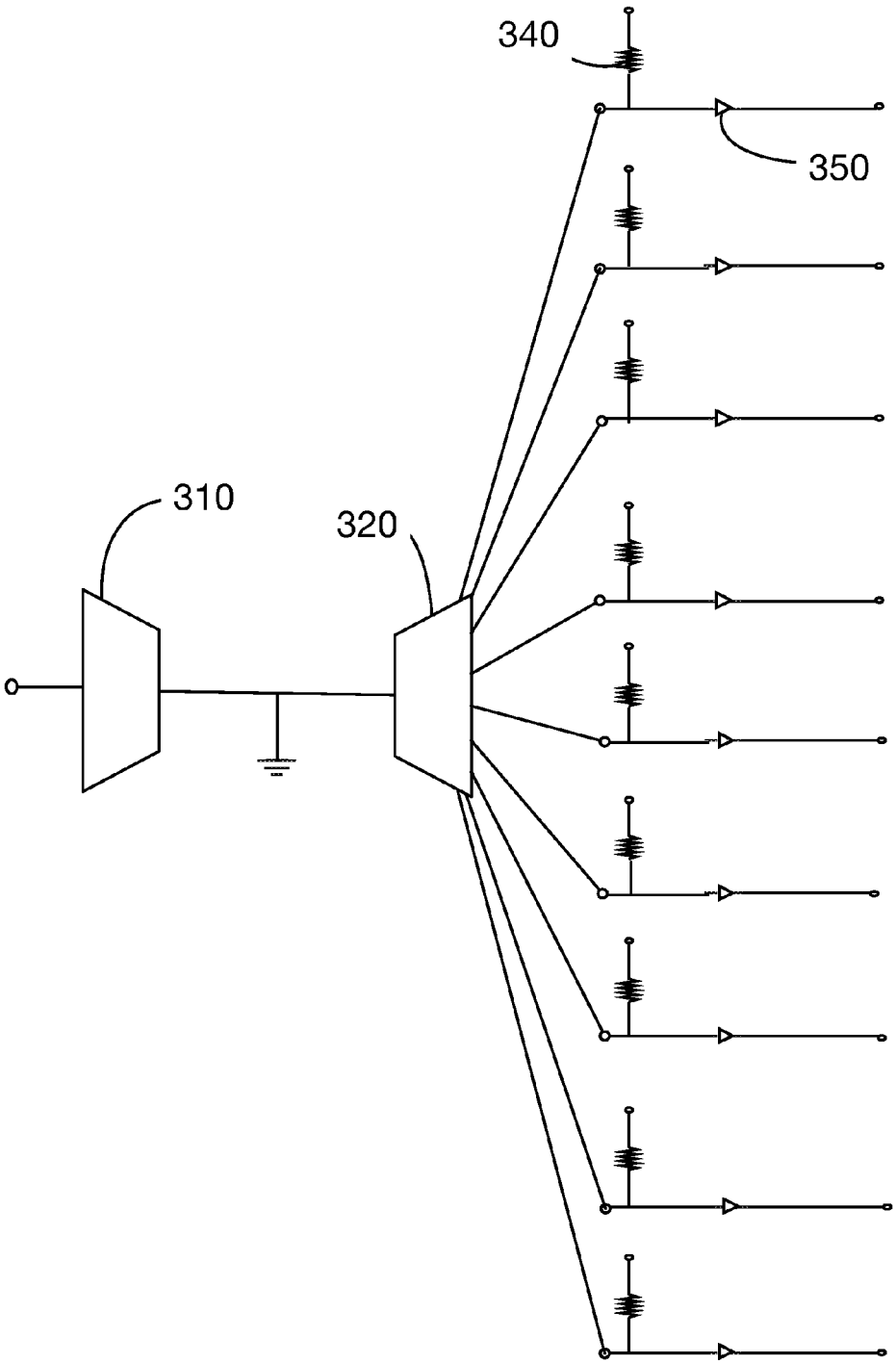
FIG. 3 illustrates a circuit schematic corresponding to a drawbar input circuit according to an embodiment of the present invention.
Figure 4:
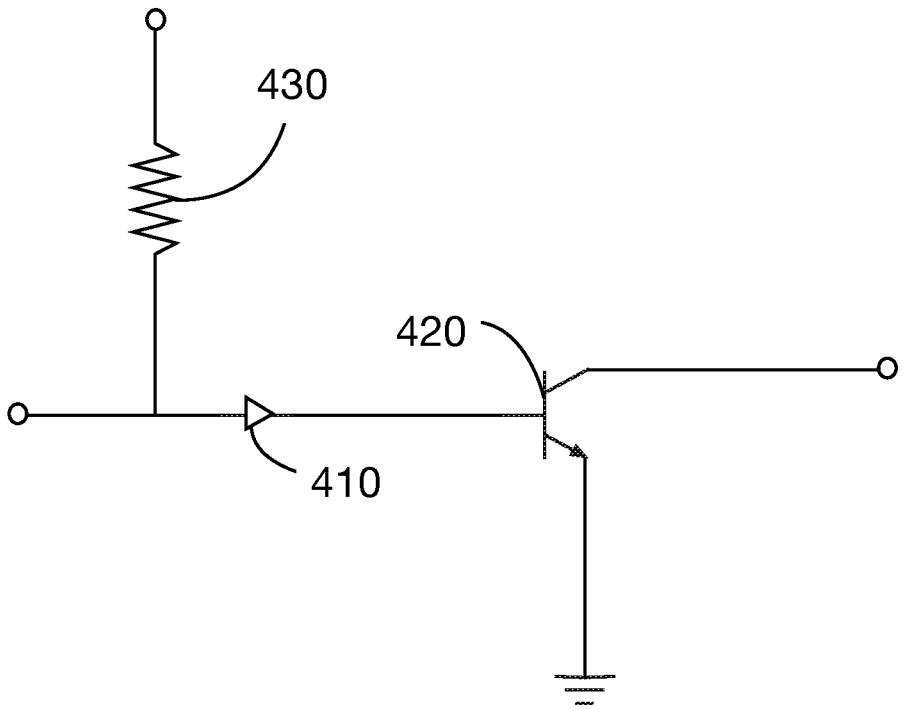
FIG. 4 illustrates a circuit schematic corresponding to a decoder according to an embodiment of the present invention.
Figure 5:
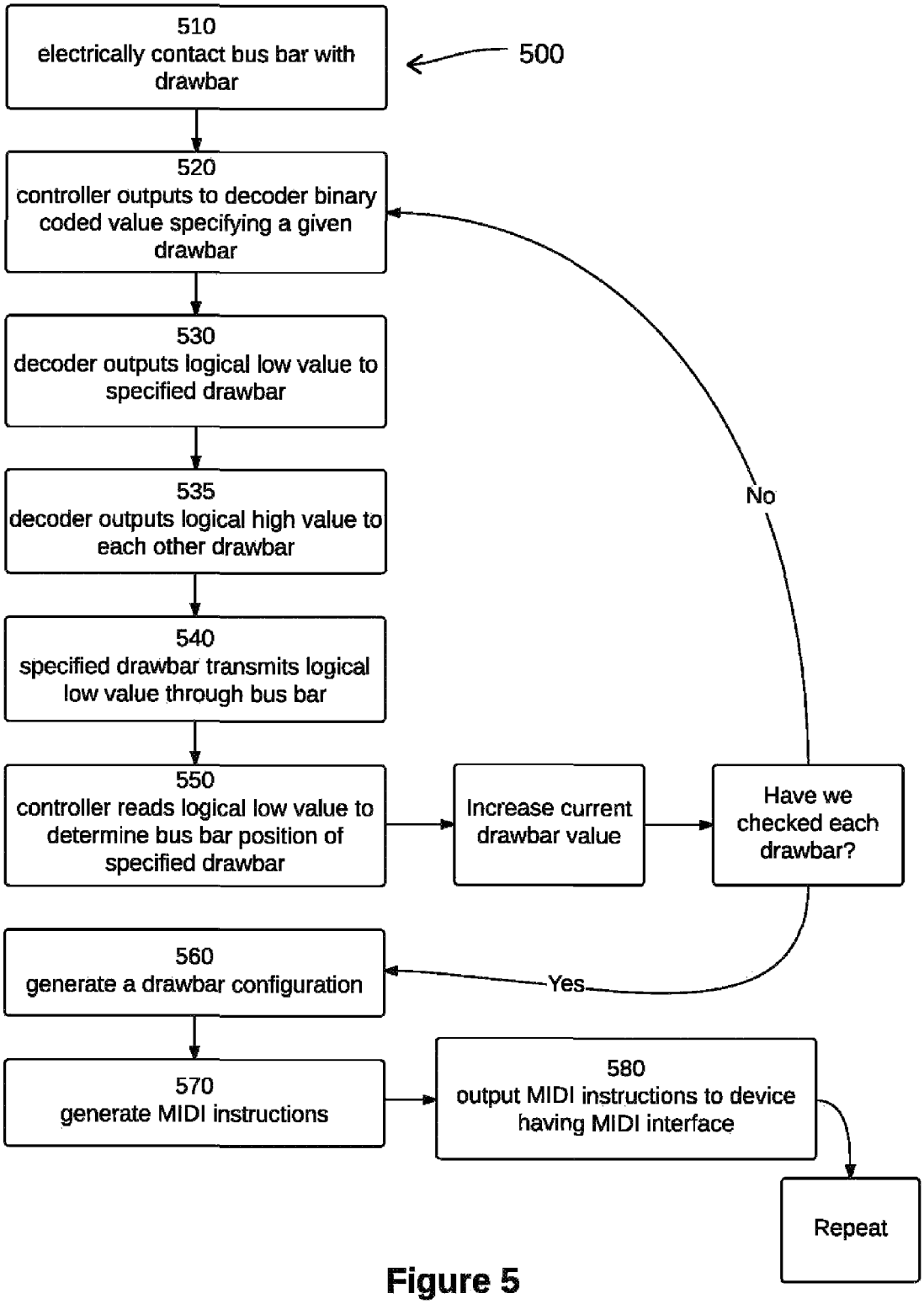
FIG. 5 illustrates a flowchart corresponding to the method of use for a MIDI controller according to an embodiment of the present invention.

Embodiments of the present invention provide a circuit board which interfaces with any, some, or all of key contacts, switches, and drawbars of a drawbar-type organ interface, and outputs MIDI instructions corresponding to the state of any, some, or all of these elements. FIG. 1 illustrates a diagram illustrating all major components for a MIDI controller according to an embodiment of the present invention. FIG. 2 illustrates a circuit schematic corresponding to a key input circuit of a set of key input circuits 120 according to an embodiment of the present invention. FIG. 3 illustrates a circuit schematic corresponding to a drawbar input circuit 130 according to an embodiment of the present invention. FIG. 4 illustrates a circuit schematic corresponding to a decoder 150 according to an embodiment of the present invention. The MIDI controller illustrated in FIG. 1 include a microcontroller 110, a set of shift registers 140, a set of decoders 150, a set of key contacts 180, a set of drawbar contacts 170, a set of bus bar input circuits 130, a set of key input circuits 120, a set of bus bars 190, a set of keys 181, a set of drawbars 171 and a MIDI output 160. FIG. 5 illustrates a flowchart 500 corresponding to the method of use for a MIDI controller according to an embodiment of the present invention.

Embodiments of the present invention provide a drawbar-type organ interface as a human interface for a MIDI controller. In some embodiments of the present invention, such a drawbar-type organ interface may include a keyboard and a group of drawbars. By way of non-limiting example, a drawbar-type organ interface according to an embodiment of the present invention, including a keyboard having two manuals with 44 keys each, including a group of 17 drawbars divided into a set of eight and a set of nine, and including a MIDI OUT port.

Additionally, it is contemplated that other embodiments of the present invention may provide drawbar-type organ interfaces having alternate keyboard and drawbar configurations. For example, embodiments of the present invention may provide a keyboard with one manual having 61 keys or a keyboard with two manuals having 61 keys each. Embodiments of the present invention may provide a group of 18 drawbars divided into two sets of nine each, a group of 36 drawbars divided into four sets of nine each, or a group of 38 drawbars divided into four sets of nine each and one set of two.

It is further contemplated that yet other embodiments of the present invention may provide drawbar interfaces without keyboards. By way of non-limiting example, a group of 17 drawbars divided into a set of eight and a set of nine.

Additionally, it is contemplated that other embodiments of the present invention may provide drawbar interfaces having other drawbar configurations. For example, embodiments of the present invention may provide a group of 18 drawbars divided into two sets of nine each, or a group of nine drawbars in a single set.

It is further contemplated that embodiments of the present invention may provide additional switch, button, and knob interfaces as are known to be part of drawbar-type organ interfaces. For example, embodiments of the present invention may provide a group of seven to ten switches.

It is further contemplated that embodiments of the present invention may provide foot pedal interfaces. By way of non-limiting example, embodiments of the present invention may provide one set of foot pedals having 12 keys, or two sets of foot pedals having 12 keys each.

Embodiments of the present invention provide electronic connections between a circuit and an interface as described above. By way of non-limiting example, an embodiment of the present invention provides electronic connections between any of the components of FIG. 1. The microcontroller 110 is electronically connected to the set of bus bar contacts 170 through the set of bus bar input circuits 130, the set of shift registers 140, the set of decoders 150, and the MIDI output 160. The set of shift registers is electronically connected to the set of key contacts 180 through the set of key input circuits 120.

Each key contact of the set of key contacts 180 electrically connects a key of a set of keys 181 of the keyboard to a set of shift registers 140 through a key input circuit, such that the electrical connection between the key and the key contact is closed when the key is depressed and the electrical connection between the key and the key contact is opened when the key is not depressed. Within the circuit illustrated in FIG. 2, each electrical connection between the key and the key contact provides a single pole, single throw switch 210 within a corresponding key input circuit connecting that key to shift register 240 of the set of shift registers 140, where the set of shift registers 140 is connected in serial to the microcontroller 110. Through a group of key input circuits 120 connected in parallel to a set of shift registers 140, each key may send a binary input to the microcontroller 110, as further detailed below.

Each key input circuit further includes a pull-up resistor 230 and a logic gate 220. The logical binary state of each logic gate 220 is maintained by the pull-up resistor connected to that logic gate 220. While a key is not depressed, the single pole, single throw switch 210 is open, and the corresponding key input circuit is broken. While a key input circuit is broken, the pull-up resistor 230 of that key input circuit pulls the voltage of the key input circuit to a logical high value. Thus, while a key is not depressed, the corresponding key input circuit sends a logical high value to the microcontroller 110.

While a key 181 is depressed, the single pole, single throw switch 210 is closed, and the corresponding key input circuit is connected. While a key input circuit is connected, the voltage of the key input circuit is set to a logical low value. Thus, while a key is depressed, the corresponding key input circuit sends a logical low value to the microcontroller 110.

Each key input circuit connects a pull-up resistor 230 in parallel to a shift register 240 of the set of shift registers 140. By way of non-limiting example, up to eight key contacts may be connected in parallel to an 8-bit shift register 240, and a set of 8-bit shift registers 140 are each connected in serial to one input/output pin of the microcontroller 110. For example, a set of thirty 8-bit shift registers 140 may provide 240 input connections for key contacts 180. By this arrangement, the set of shift registers 140 provides a serial input circuit that inputs the binary states of each key connected to the set of shift registers 140 to a pin of the microcontroller 110. Thus, binary inputs from up to 146 keys may be received by one input/output pin of the microcontroller 110.

By the principles as described above, foot pedal keys as well as additional switch, button, and knob interfaces may send inputs to the microcontroller 110 through input circuits connected to the input connections of the set of shift registers 140.

Each set of drawbars 171 operates by coming into electrical contact with a set of nine bus bars forming a set of drawbar contacts 170. By way of non-limiting example, organ interfaces having one set of drawbars may have one set of nine bus bars, while organ interfaces having two sets of drawbars may have eighteen bus bars in two sets of nine each, where each set of bus bars corresponds to a set of drawbars. Each drawbar may be extended or depressed such that it is in electrical contact with a bus bar.

Each drawbar contact is electrically connected in a bus bar input circuit 130 to an input pin of the microcontroller 110. During step 510 of flowchart 500 of FIG. 5, while a bus bar is in electrical contact with one or more drawbar contacts, the corresponding bus bar input circuit 130 is connected, and while a bus bar is not in closed electrical contact with any drawbar contacts, the corresponding bus bar input circuit 130 is broken. Each drawbar contact provides combination of multiplier 310 and demultiplier 320 that switches between nine bus bar input circuits 130 connecting each bus bar to the microcontroller 110. Furthermore, the combination of multiplier 310 and demultiplier 320 is shaped with respect to the positioning of a set of nine bus bars such that it may break one bus bar input circuit 130 before connecting another bus bar input circuit 130. Each drawbar contact thereby serves as a break-before-make switch with respect to the bus bar input circuits 130. Each bus bar input circuit 130 that is connected may send a binary input to the microcontroller 110, and the microcontroller 110 may use these binary inputs to monitor the position of each drawbar, as further detailed below.

During step 520 of flowchart 500 of FIG. 5, to determine the position of each drawbar, the microcontroller 110 sends a binary coded digital value corresponding to each drawbar to an input of a decoder 150. By way of non-limiting example, each decoder 150 may be an active low 4-to-16 decoder having four inputs and sixteen open collector outputs 420, where each open collector output 420 is electronically connected to a drawbar.

While an open collector output 420 of a decoder 150 is not selected by that decoder 150, that open collector output 420 is open-circuited and outputs a logical high value to the corresponding drawbar. Upon receiving a binary input from the microcontroller 110 corresponding to a drawbar, the decoder 150 selects the open collector output 420 corresponding to that drawbar. During step 530 of flowchart 500 of FIG. 5, when an open collector output 420 of the decoder 150 is selected, the open collector output 420 outputs a logical low value to the corresponding drawbar. During step 535 of flowchart 500 of FIG. 5, while an open collector output 420 corresponding to a drawbar is selected, each other open collector output 420 outputs a logical high value to the corresponding drawbar.

Each bus bar input circuit 130 includes a pull-up resistor 340 and logic gate 350 connected to each bus bar 190. The logical binary state of each bus bar 190 is maintained by the pull-up resistor 340 connected to that bus bar 190. While a bus bar is not in contact with a drawbar contact 170, the corresponding bus bar input circuit 130 is broken. While a bus bar input circuit 130 is broken, the pull-up resistor 340 of that bus bar input circuit 130 pulls the voltage of the bus bar input circuit 130 to a logical high value. Thus, while a bus bar 190 is not in contact with a drawbar contact 170, the corresponding bus bar input circuit 130 sends a logical high value to the microcontroller 110.

While a bus bar is in electrical contact with a drawbar contact, the corresponding bus bar input circuit is connected. While a bus bar input circuit 130 is connected, the voltage of the bus bar input circuit 130 is set to a logical low value. Thus, during step 540 of flowchart 500 of FIG. 5, while a bus bar is in contact with a drawbar contact, the corresponding bus bar input circuit 130 sends a logical low value to the microcontroller 110. The microcontroller 110 receives binary inputs from the bus bar input circuits 130 that are in contact with drawbars.

A bus bar input circuit 130 may be in contact with more than one drawbar 171 at a time. When the open collector output 420 corresponding to a drawbar 171 is selected, a logical low value may be outputted to one drawbar 171 while logical high values are outputted to the other drawbars 171. Because open collector outputs 420 are used, only one drawbar 171 at a time creates a connected circuit with the bus bar input circuit 130, while the other drawbars 171 remain as open circuits, and their logical high values are not input into the connected circuit. Thus, embodiments of the invention as described herein prevent the creation of a circuit having both a logical low value and a logical high value simultaneously when a bus bar input circuit 130 is in contact with more than one drawbar 171.

Furthermore, because each drawbar contact 170 is a break-before-make switch, each drawbar contact 170 may only contact one bus bar input circuit 130 at a time. Thus, a drawbar contact 170 cannot short two bus bar input circuits 130 together. When an open collector output 420 corresponding to a drawbar is selected, the drawbar contact 170 connects up to one bus bar input circuit 130, and up to one bus bar input circuit 130 receives a logical low value from the selected open collector output 420.

Consequently, when an open collector output 420 corresponding to a drawbar is selected, and that drawbar is in electrical contact with a bus bar 190, the microcontroller 110 receives a logical low value from the corresponding bus bar input circuit 130. The microcontroller 110 may determine from this input that the drawbar 171 corresponding to the selected open collector output 420 is in contact with the bus bar 190 corresponding to the bus bar input circuit 130 sending the logical low value. By the decoders 150 selecting each open collector output 420 in turn, the microcontroller 110 may determine the position of each drawbar 191 of the drawbar-type organ interface.

By the steps as described above, on step 560 of flowchart 500 of FIG. 5, the microcontroller 110 may determine any, some, or all of the state of each manual key, the state of each foot pedal key, the state of additional switch, button, and knob interfaces, and the position of each drawbar. On step 570 of flowchart 500 of FIG. 5 the microcontroller 110 may then output a set of MIDI instructions based upon any, some or all of the state of each manual key, the state of each foot pedal key, the state of additional switch, button, and knob interfaces, and the position of each drawbar through the MIDI output 160. On step 580 of flowchart 500 of FIG. 5, a set of MIDI instructions may be transmitted through the MIDI output 160 to any suitable device known to persons of ordinary skill in the art as having an interface for receiving MIDI instructions, an electronic processor for processing MIDI instructions, and an audio generator for generating audio based on MIDI instructions. Such devices may include, but are not limited to, music synthesizers, electronic musical instruments, drum machines, and computers running software synthesizers.

Such devices may also include devices that emulate the sound generated by a drawbar-type organ. By way of non-limiting example, an electronic instrument may be the Roland VK-88 keyboard. By way of non-limiting example, a software synthesizer running on a computer may be Native Instruments B4.

Embodiments of the present invention may provide connections with a drawbar-type organ interface taken from a model produced by the Hammond Instrument Company. An interface including any, some, or all of manuals, foot pedals, switches, and drawbars may be taken from a B-series organ, such as the B-3 or BV; an M-series organ, such as the M-2 or M-3; or any other models known to be suitable by persons of ordinary skill in the art. Thus, embodiments of the present invention may provide a MIDI keyboard controller having the interface of a Hammond organ, while having a weight of hundreds of pounds less than a Hammond organ due to the absence of components such as tonewheels and amplifier circuits.

Embodiments of the present invention also provide a circuit that may be connected to numerous different configurations of drawbar-type organ interfaces having differing numbers of keys, switches, and drawbars, as well as stand-alone units having only keys and drawbars, only foot pedals and drawbars, or only drawbars.

While particular elements, embodiments, and applications of the present invention have been shown and described, the invention is not limited thereto because modifications may be made by those skilled in the art, particularly in light of the foregoing teaching. It is therefore contemplated by the application to cover such modifications and incorporate those features which come within the spirit and scope of the invention.

What is claimed is:

1. A drawbar-type organ input circuit, comprising:

a plurality of drawbars;

a plurality of bus bars;

a controller having a plurality of input/output pins; and a decoder having a plurality of inputs and a plurality of outputs;

wherein each bus bar of the plurality of bus bars is electrically connected to an input/output pin of the controller;

wherein each input of the decoder is electrically connected to an input/output pin of the controller; and wherein each output of the decoder is electrically connected to a drawbar of the plurality of drawbars.

2. The input circuit of claim 1, wherein each drawbar of the plurality of drawbars is adjustable through a range of positions, wherein a drawbar electrically contacts a bus bar at each position of the range of positions.

3. The input circuit of claim 2, wherein a drawbar electrically contacts only one bus bar at each position of the range of positions.

4. The input circuit of claim 2, wherein a drawbar electrically contacting a bus bar completes a circuit connecting the drawbar to the input/output pin electrically connected to the bus bar.

5. The input circuit of claim 4, wherein a drawbar electrically contacting a bus bar sends a binary value to the input/output pin electrically connected to the bus bar.

6. The input circuit of claim 5, wherein the controller determines the position of the drawbar electrically contacting a bus bar by reading the binary value received from the input/output pin electrically connected to the bus bar.

7. The input circuit of claim 6, further comprising a MIDI output electronically connected to an input/output pin of the controller.

8. The input circuit of claim 7, wherein the controller outputs a MIDI instruction to the MIDI output based on the position of the drawbar electrically contacting a bus bar.

9. The input circuit of claim 1, wherein each output of the decoder is an open collector output.

10. A method of determining the positions of drawbars of a drawbar-type organ interface, comprising:

electrically contacting a bus bar of a plurality of bus bars with a drawbar of a plurality of drawbars, wherein each bus bar is electrically connected to an input of a controller;

selecting a drawbar of a plurality of drawbars by a controller outputting a binary coded value specifying a drawbar to a decoder having a plurality of outputs, wherein each output of the plurality of outputs is electrically connected to a drawbar of the plurality of drawbars;

the decoder outputting a logical low value to the specified drawbar;

the specified drawbar transmitting a logical low value through the bus bar electrically contacted by the specified drawbar; and the controller reading the logical low value to determine that the position of the specified drawbar is at the bus bar electrically contacted by the specified drawbar.

11. The method of claim 10, further comprising the decoder outputting a logical high value to each drawbar other than the specified drawbar.

12. The method of claim 11, further comprising repeating the steps of the method of claim 11 by specifying each other drawbar, and generating a drawbar configuration by determining that the position of each specified drawbar is at a bus bar electrically contacted by each specified drawbar.

13. The method of claim 12, further comprising generating a MIDI instruction based on the drawbar configuration.

14. The method of claim 13, further comprising outputting the MIDI instruction to a device having an interface for receiving MIDI instructions.

* * * * *